US009692132B2

(12) United States Patent
Kawaguchi et al.

(10) Patent No.: US 9,692,132 B2
(45) Date of Patent: Jun. 27, 2017

(54) ANTENNA APPARATUS HAVING PATCH ANTENNA

(71) Applicant: DENSO CORPORATION, Kariya, Aichi-pref. (JP)

(72) Inventors: Kazushi Kawaguchi, Anjo (JP); Yuji Sugimoto, Kariya (JP); Asahi Kondo, Kariya (JP); Masanobu Yukumatsu, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 14/775,583

(22) PCT Filed: Mar. 12, 2014

(86) PCT No.: PCT/JP2014/056573

§ 371 (c)(1),
(2) Date: Sep. 11, 2015

(87) PCT Pub. No.: WO2014/142202

PCT Pub. Date: Sep. 18, 2014

(65) Prior Publication Data

US 2016/0028161 A1 Jan. 28, 2016

(30) Foreign Application Priority Data

Mar. 13, 2013 (JP) ..... 2013-050640

(51) Int. Cl.
*H01Q 9/04* (2006.01)
*H01Q 1/28* (2006.01)
(Continued)

(52) U.S. Cl.
CPC ..... *H01Q 9/0407* (2013.01); *H01Q 1/28* (2013.01); *H01Q 1/32* (2013.01); *H01Q 15/008* (2013.01); *H01Q 21/065* (2013.01)

(58) Field of Classification Search
CPC ..... H01Q 9/0407; H01Q 1/28; H01Q 1/32; H01Q 15/008; H01Q 21/065
See application file for complete search history.

(56) References Cited

U.S. PATENT DOCUMENTS 6,262,495 B1 * 7/2001 Yablonovitch ..... H01Q 1/48 307/101
7,330,161 B2 * 2/2008 Matsugatani ..... H01Q 9/0421 343/700 MS (Continued)

FOREIGN PATENT DOCUMENTS

JP 2001-267839 A 9/2001
JP 2002-510886 A 4/2002

(Continued)

OTHER PUBLICATIONS

International Preliminary Report on Patentability; International Application No. PCT/JP2014/056573; Filed: Mar. 12, 2014 (with English translation).

(Continued)

*Primary Examiner* — Hoang Nguyen
(74) *Attorney, Agent, or Firm* — Knobbe, Martens, Olson & Bear, LLP

(57) ABSTRACT

An antenna apparatus includes a dielectric substrate, a ground plate, a patch antenna provided with a patch radiating element, and a plurality of EBGs (Electromagnetic Band Gaps). The EBGs are composed of patch-shaped patterns formed on a surface of the substrate and connecting conductors electrically connecting the patch-shaped patterns and the ground plate. Each EBG is arranged to provide an EBG absent region having no EBG on the surface of the substrate. The patch radiating element is arranged within the EBG absent region. The EBG absent region is formed such that distances (absent distances) in a dominant polarized wave direction changes into a plurality of types depending (Continued)

on the position on a vertical patch line, where the distances range, to the boundary of the region, from an arbitrary position on the virtual patch line which is perpendicular to the dominant polarized wave direction of the patch antenna.

18 Claims, 11 Drawing Sheets

(51) Int. Cl.
*H01Q 1/32* (2006.01)
*H01Q 15/00* (2006.01)
*H01Q 21/06* (2006.01)

(56) References Cited

U.S. PATENT DOCUMENTS

| | | | | |
|---|---|---|---|---|
| 7,847,737 | B2 * | 12/2010 | Kuroda ..... | H01Q 9/0407 343/700 MS |
| 2007/0075903 | A1 | 4/2007 | Matsugatani et al. | |

FOREIGN PATENT DOCUMENTS

| | | | |
|---|---|---|---|
| JP | 2003-304113 | A | 10/2003 |
| JP | 2007-104211 | A | 4/2007 |
| JP | 2009-096249 | A | 5/2009 |
| JP | 2012-122801 | A | 6/2012 |
| WO | 2014/142202 | A1 | 9/2014 |

OTHER PUBLICATIONS

International Search Report (translated version); International Application No. PCT/JP2014/056573, filed Mar. 12, 2014; 3 pages.

* cited by examiner (a)

(b)

(a) DETAILS OF SECTION A (b) DETAILS OF SECTION B (a) DETAILS OF SECTION C (b) DETAILS OF SECTION D (a) E-E CROSS-SECTION (b) F-F CROSS-SECTION (a) CONFIGURATION IN WHICH EBGs ARE NOT PROVIDED (REFERENCE)

(b) CONFIGURATION IN WHICH EBGs ARE PROVIDED (PRESENT INVENTION APPLIED)

(a) CONFIGURATION IN WHICH EBGs ARE NOT PROVIDED (REFERENCE)

(b) EBGs PROVIDED; QUADRANGULAR SPACE ARRANGEMENT (REFERENCE)

(c) EBGs PROVIDED; RHOMBIC SPACE ARRANGEMENT (PRESENT INVENTION APPLIED)

ANTENNA APPARATUS HAVING PATCH ANTENNA

CROSS-REFERENCE TO RELATED APPLICATION

This application is based on and claims the benefit of priority from earlier Japanese Patent Application No. 2013-050640 filed Mar. 13, 2013, the description of which is incorporated herein by reference.

BACKGROUND

Technical Field

Technical Background

The present invention relates to an antenna apparatus. In particular, the present invention relates to an antenna apparatus that has a patch antenna.

Various types of antenna apparatuses are used in moving objects, such as vehicles and aircrafts. Among these antenna apparatuses, a patch antenna, which is formed on a dielectric substrate, is used, for example, in a radar that monitors the periphery of such a moving object. The patch antenna is typically configured such that a patch radiating element (a patch-shaped conductor) is formed on the dielectric substrate. In addition, a conductor portion is typically formed on a surface (referred to, hereafter, as a "substrate back surface") of the dielectric substrate opposite the surface on which the patch radiating element is formed (referred to, hereafter, as a "substrate front surface"). The conductor portion functions as a ground plate. Furthermore, a conductor portion may also be formed on the substrate front surface, separately from the patch radiating element. This conductor portion is widely formed to reach the substrate end portions.

In the patch antenna configured as described above, when the patch antenna operates, a current (surface current) flows to the ground plate surface. The surface current is attributed to an electrical field formed between the patch radiating element and the ground plate. The surface current is transmitted to the substrate end portions and results in emission (radiation) from the substrate end portions. When the conductor portion is formed on the substrate front surface, the surface current also flows to the conductor portion, thereby causing the emission from the substrate end portions. The emission from the substrate end portions caused by the surface current is unnecessary emission that affects the performance of the patch antenna. In other words, the emission from the end portions causes disturbance in the directivity of the patch antenna.

Therefore, PTL 1 discloses a technique for suppressing the surface current flowing to the ground plate. Specifically, a plurality of conductive patches are formed in the overall periphery of the patch radiating element, on the substrate front surface of the dielectric substrate. Each conductive patch is electrically connected to the ground plate on the substrate back surface by a conductive via. This configuration composed of the conductive patch and the conductive via has a band gap (electromagnetic band gap) that inhibits the transmission of surface current through the ground plate at a certain frequency. This configuration composed of the conductive patch and the conductive via is referred to, hereafter, as an "EBG".

A plurality of EBGs are provided in this way on the overall surface surrounding the patch radiating element. As a result, the transmission of surface current to the substrate end portions is suppressed, and disturbance in the directivity of the patch antenna is thereby suppressed.

CITATION LIST

Patent Literature

[PTL 1] JP-A1-2002-510886

Technical Problem

However, in the technique described in PTL 1, the EBGs are arranged on the overall surface surrounding the patch radiating element on the substrate. Therefore, the transmission of surface current to the substrate end portions is firmly suppressed. As a result, beam width decreases.

In other words, the transmission of surface current is suppressed and the disturbance in directivity can be suppressed. However, as a result of the transmission of surface current being firmly suppressed, the ground of the patch antenna is substantially decreased. The beam width decreases. The decrease in beam width leads to narrowing of the communicable range, and is therefore not preferable in practical use.

SUMMARY

Thus it is desired to achieve both suppression of disturbance in directivity caused by surface current and retention of desired beam width in an antenna apparatus in which a patch antenna is formed on a dielectric substrate.

An antenna apparatus of an exemplary embodiment includes a dielectric substrate in which a ground plate (ground plane) is formed on one substrate face, of two substrate faces. The antenna apparatus also includes a patch antenna and a plurality of conductive structures formed on the dielectric substrate.

The patch antenna has at least a single patch radiating element for power supply. The patch radiating element is formed on the other substrate face of the dielectric substrate, opposite the one substrate face on which the ground plate is formed. A predetermined direction on the substrate face of the dielectric substrate is set as a dominant polarized wave direction. The conductive structure has a patch-shaped conductor pattern that is formed on a substrate front surface, which is the other substrate face. The conductive structure also has a connecting conductor that is formed such as to pass through the dielectric substrate between the conductor pattern and the ground plate in order to electrically connect the conductor pattern and the ground plate. A plurality of conductive structures are provided.

The plurality of conductive structures are arranged such that a structure absent region is formed on the substrate front surface by the conductive structures. The structure absent region completely includes the patch radiating element of the patch antenna. In addition, the conductor pattern of the conductive structure is not present in the structure absent region.

A line that is perpendicular to the dominant polarized wave direction and passes through substantially the center of the patch antenna in the dominant polarized wave direction is set as a patch line. The structure absent region is formed by the plurality of conductive structures such that, in both an area further towards one end side of the dielectric substrate than the patch line and an area further towards the other end side of the dielectric substrate than the patch line, an absent distance changes into a plurality of types depending on the position on the patch line. The absent distance refers to the distance in the dominant polarized wave direction from an arbitrary position on the patch line to a conductor pattern forming the boundary of the structure absent region.

In the antenna apparatus configured as described above, the plurality of conductive structures (conductor patterns) are not adjacently arranged on the substrate front surface such as to be adjacent to the patch radiating element over the entire periphery of the patch radiating element. Rather, the structure absent region in which the conductor pattern is not present is provided in the periphery of the patch radiating element. The plurality of conductor patterns are arranged outside of the structure absent region.

The structure absent region is formed by the conductor patterns as a result of the conductor patterns being arranged such as to surround the patch radiating element. The region boundary of the structure absent region is determined by the arrangement state of the conductor patterns. In other words, in the region boundary of the structure absent region, the conductor patterns are arranged along a part of the region boundary or over the entire region boundary.

Furthermore, in the structure absent region, the absent distance is not the same when viewed in the dominant polarized wave direction from any position on the patch line. The absent distance differs depending on the position on the patch line. In other words, when viewed towards the substrate end portion side in the dominant polarized wave direction from an arbitrary position on the patch line, the absent distance is the distance from this position to the first, nearest conductor pattern present on the region boundary (the distance over which a conductor pattern is not present) or a distance corresponding thereto.

The conductive structure functions to attenuate the surface current transmitted in the dominant polarized wave direction from the patch antenna to the substrate end portion. Therefore, as the absent distance increases, the distance over which the surface current is transmitted toward the substrate end portion side increases.

A longer absent distance is preferred in order to increase beam width. Therefore, when only widening of the beam width is considered, the absent distance is preferably long at any position on the patch line. However, when the absent distance is long from any position on the patch line and the surface current is transmitted to the vicinity of the substrate end portions, directivity is disturbed as a result of concentrated radiation from the vicinity of the substrate end portions. Meanwhile, when only suppression of disturbance in directivity is considered, the absent distance is preferably shortened as much as possible to suppress the transmission of surface current. However, when the absent distance from every point on the patch line is shortened and the transmission of surface current is suppressed, the beam width becomes narrow.

In this regard, in the antenna apparatus, as described above, the structure absent region is provided in the periphery of the patch radiating element. In addition, in the structure absent region, the absent distance from the patch line differs depending on the position on the patch line. Therefore, while the absent distance is increased and the surface current is transmitted over a long distance from a certain position on the patch line, the absent distance is shortened at another position on the patch line. Radiation positions can be dispersed as a whole.

Therefore, in the antenna apparatus, the conductive structures are arranged to form the structure absent region. As a result, the transmission distance of the surface current can be ensured and the desired beam width can be retained. In addition, the structure absent region is formed (the conductive structures are arranged) such that the absent distance in the structure absent region differs depending on the position on the patch line. As a result, the radiation position for radiation attributed to surface current can be dispersed and disturbance in directivity can be suppressed.

Reference numbers within the parentheses in the scope of claims are examples indicating corresponding relationships with specific means and the like described according to the embodiments, described hereafter. The present invention is not limited to the specific means and the like indicated by the reference numbers within the parentheses.

DESCRIPTION OF EMBODIMENTS

Preferred embodiments of the present invention will hereinafter be described with reference to the drawings.

The present invention is not limited to the specific means, configurations, and the like described according to the embodiments below. Various embodiments are possible without departing from the spirit of the present invention. In addition, the embodiments of the present invention include embodiments in which some of the configurations according to the embodiments below are omitted to an extent allowing the problem to be solved. Furthermore, the embodiments of the present invention also include embodiments in which a plurality of the embodiments below are combined as appropriate.

[First Embodiment]

Figure 1:
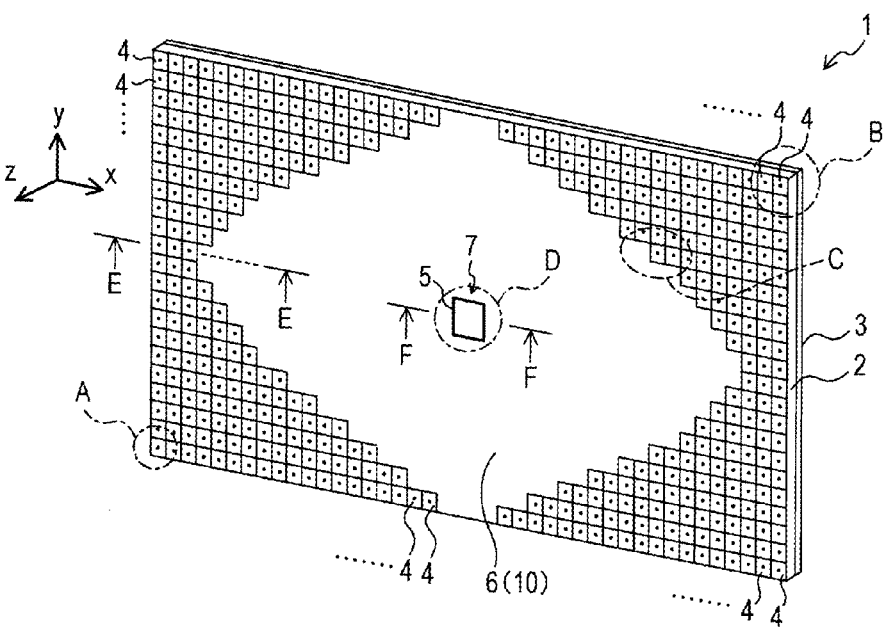
FIGS. 1(*a*) and 1(*b*) show explanatory diagrams of an overall configuration of an antenna apparatus according to a first embodiment.
Figure 1:
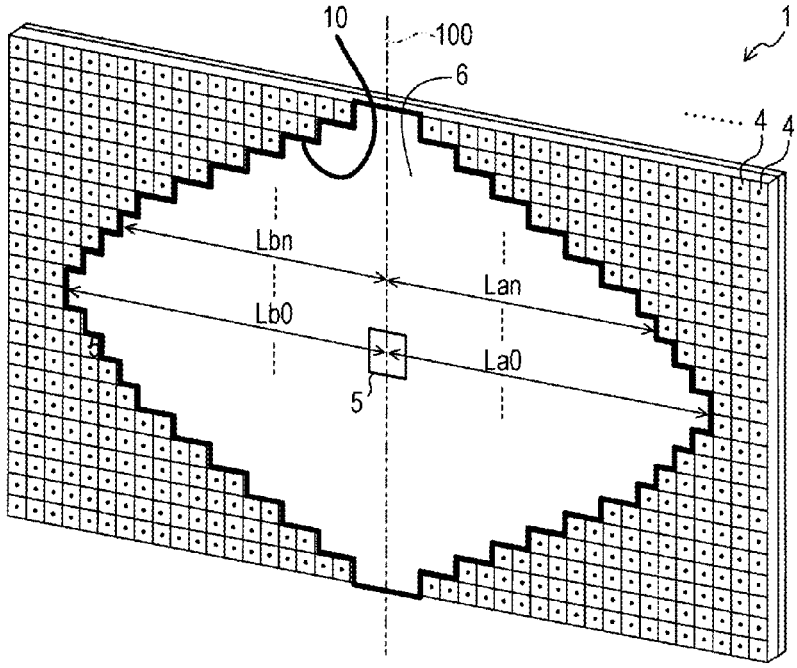

As shown in FIG. 1(*a*), an antenna apparatus 1 according to the present embodiment is configured such that a patch antenna 7, a conductor plate 6, and a plurality of electromagnetic band gaps (EBGs) 4 are formed on one surface (substrate front surface) of a rectangular dielectric substrate 2. A ground plate (ground plane) 3 composed of a conductor is formed on the other surface (substrate back surface) of the dielectric substrate 2. In the description hereafter, the long-side direction (lateral direction in FIG. 1(*a*)) of the dielectric substrate 2 is referred to as an x-axis direction. The short-side direction (vertical direction in FIG. 1(*a*)) of the dielectric substrate 2 is referred to as a y-axis direction. The direction perpendicular to the substrate face of the dielectric substrate 2 is referred to as a z-axis direction.

Figure 2:
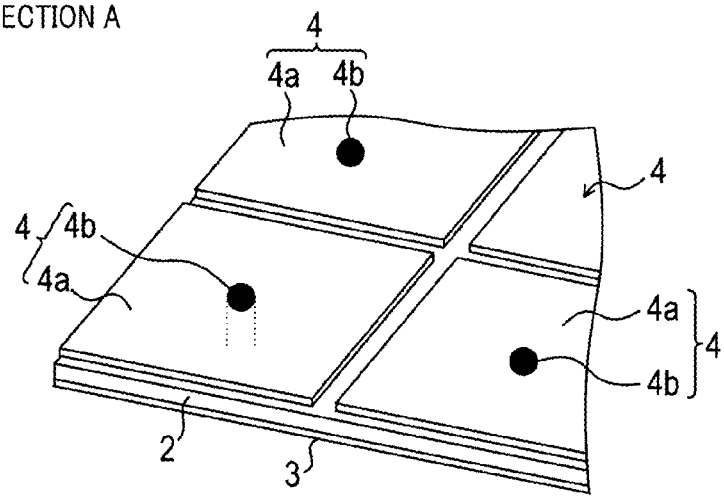
FIGS. 2(*a*) and 2(*b*) show detailed partial views of the antenna apparatus according to the first embodiment.
Figure 2:
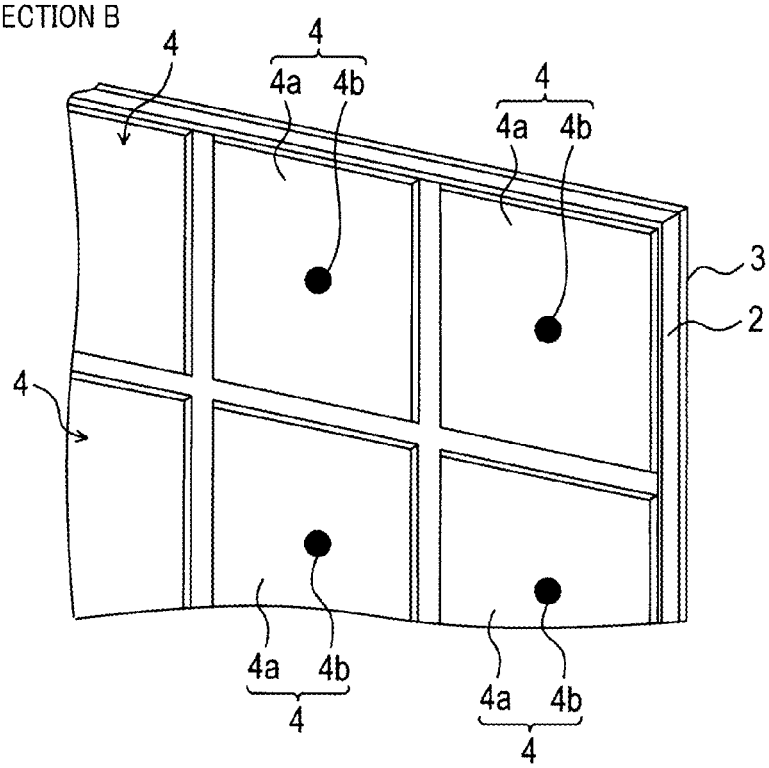
Figure 3:
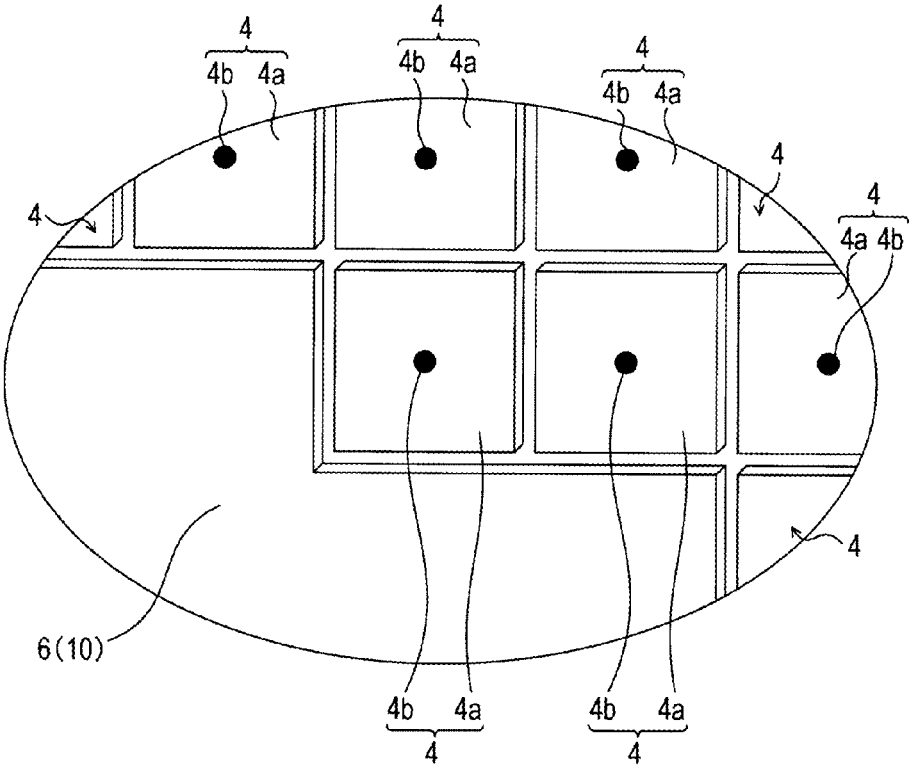
FIGS. 3(*a*) and 3(*b*) show detailed partial views of the antenna apparatus according to the first embodiment.
Figure 3:
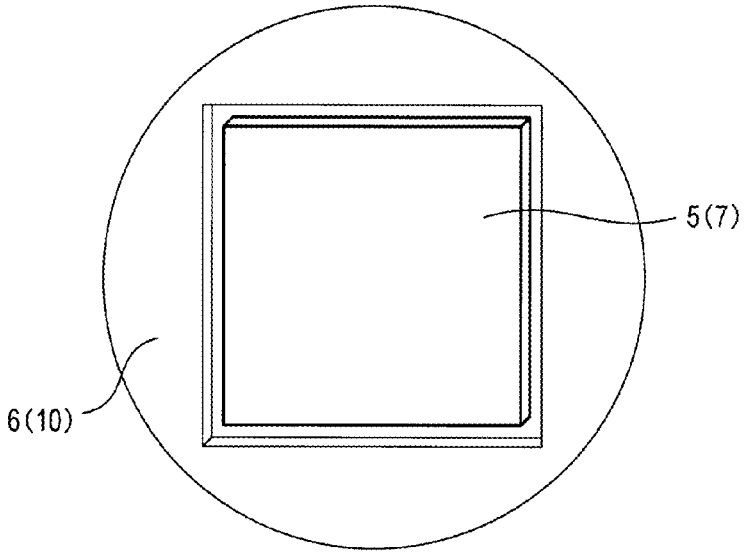
Figure 4:
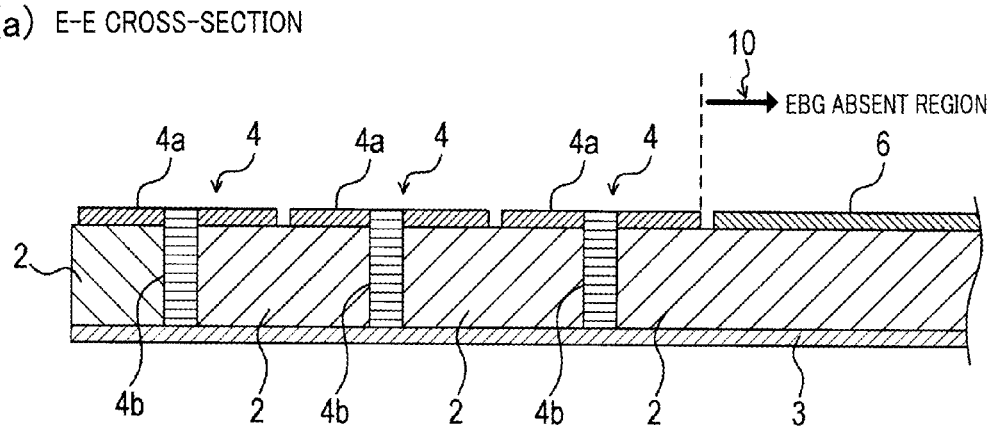
FIGS. 4(*a*) and 4(*b*) show partial cross-sectional views of the antenna apparatus according to the first embodiment.
Figure 4:
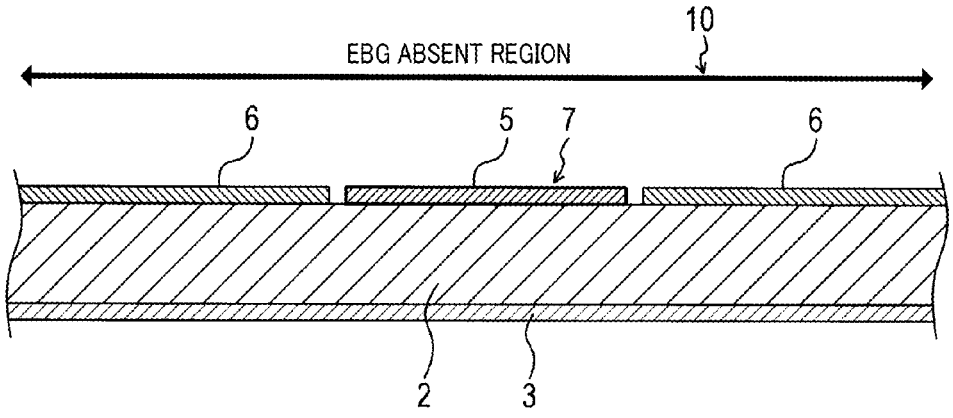

FIG. 2(*a*) and FIG. 2(*b*) show detailed (enlarged) views of section A and section B, which are indicated by broken-line circles, in the antenna apparatus 1 in FIG. 1(*a*). FIG. 3(*a*) and FIG. 3(B) show detailed (enlarged) views of section C and section D, which are indicated by broken-line circles, in the antenna apparatus 1 in FIG. 1(*a*). FIG. 4(*a*) and FIG. 4(*b*) show cross-sectional views taken along line E-E and line F-F in the antenna apparatus 1 in FIG. 1(*a*).

For example, the antenna apparatus 1 is disposed on the front of a vehicle such that the substrate front surface, on which the patch antenna 7 is formed, faces the direction ahead of the vehicle. In addition, the antenna apparatus 1 is disposed such that the long side of the rectangular dielectric substrate 2 is horizontal in relation to the ground surface. The antenna apparatus 1 is used as a millimeter-wave radar for monitoring the periphery of the vehicle. Therefore, in the description hereafter, the plane (that is, an xz plane perpendicular to the y-axis direction) parallel to the long side of the dielectric substrate 2 is also referred to as a horizontal plane.

The patch antenna 7 has the square patch radiating element 5. The patch radiating element 5 is formed in the center portion of the substrate front surface. The ground plate 3 on the substrate back surface functions as the ground plate of the patch antenna 7. The square patch radiating element 5 is arranged such that one pair of opposing sides is parallel in the x-axis direction and the other pair of opposing sides is parallel in the y-axis direction.

As FIG. 3(*b*) and FIG. 4(*b*) also clearly indicate, the conductor plate 6 is formed in the periphery of the patch radiating element 5. However, a groove is formed between the patch radiating element 5 and the conductor plate 6 over the entire periphery of the patch radiating element 5. The patch radiating element 5 is physically separated from the conductor plate 6 by the groove.

In addition, the length of one side of the patch radiating element 5 is substantially $\lambda g/2$. Here, $\lambda g$ represents the wavelength within the dielectric. When the free space wavelength is $\lambda 0$ and the dielectric constant of the dielectric substrate 2 is $\in r$, $\lambda g=\lambda 0/\sqrt{\in r}$. However, the length of substantially $\lambda g/2$ is an example. The optimal length varies depending on various factors, such as the shape and size of the ground plate 3.

Power is supplied to the patch antenna 7 through the path radiating element 5. However, an illustration of a configuration for supplying power to the patch radiating element 5 is omitted. Various methods for supplying power to a patch-shaped radiating element have been considered and put to actual use. Therefore, a detailed description thereof is omitted. However, according to the present embodiment, a configuration is used in which power is supplied from a microstrip line for power supply using an electromagnetic coupling-type power supply method.

The patch antenna 7 operates with the long-side direction (x-axis direction) of the dielectric substrate 2 as the dominant polarized wave direction. That is, the patch antenna 7 is configured and used as an antenna capable of favorably transmitting and receiving horizontally polarized waves.

As FIG. 2, FIG. 3(*a*), and FIG. 4(*a*) clearly indicate, the EBG 4 is composed of a patch-shaped metal pattern (referred to, hereafter, as a "patch-shaped pattern") 4*a* that is formed on the substrate front surface of the dielectric substrate 2. The EBG 4 is also composed of a conductive via (referred to, hereafter, as simply a "via") 4*b* that electrically connects the center portion of the patch-shaped pattern 4*a* and the ground plate 3.

The shape of the patch-shaped pattern 4*a* (the shape of the plane parallel to the substrate face) according to the present embodiment is a square. The length of one side of the square is substantially $\lambda g/5$ to $\lambda g/10$. However, this length is an example and varies depending on the permittivity of the dielectric substrate 2. The via 4B is provided such as to pass through the dielectric substrate 2 in the direction perpendicular to the substrate face (z-axis direction). The patch-shaped pattern 4*a* is connected to one end side of the via 4*b*. The ground plate 3 is connected to the other end side.

A plurality of EBGs 4 are provided in the antenna apparatus 1. Specifically, a plurality of patch-shaped patterns 4*a* are arrayed at a predetermined interval in the overall area of the substrate front surface, excluding an EBG absent region 10 (see FIG. 1(*b*)). Each of the square patch-shaped patterns 4*a* is arranged such that one pair of opposing sides is parallel in the x-axis direction. The other pair of opposing sides is parallel in the y-axis direction. The patch-shaped patterns 4*a* are arrayed on the substrate front surface such as to be separated by a minute distance (a distance sufficiently shorter than the wavelength corresponding to the usage frequency of the antenna apparatus 1).

Each EBG 4 is capacitively coupled with another adjacent EBG 4. In addition, each EBG 4 is inductively and capacitively coupled with the ground plate 3 on the substrate back surface. As a result, the EBGs 4, as a whole, function as a two-dimensional circuit network of a parallel resonant circuit. The transmission of surface current to both substrate ends (both ends in the dominant polarized wave direction), which occurs as a result of operation (radiation) of the patch antenna 7, can be inhibited (or suppressed).

The patch radiating element 5 is present in the center portion of the EBG absent region 10. No patch-shaped patterns 4*a* are present in the EBG absent region 10. The overall EBG absent region 10 is formed into a rhomboid. The boundary (region boundary) of the EBG absent region 10 is formed by a plurality of patch-shaped patterns 4*a* and the end sides of the dielectric substrate 2. In other words, the patch-shaped patterns 4*a* are arranged so as to form the rhombic EBG absent region 10. The patch-shaped patterns 4*a* can be said to be arranged along the region boundary of the rhombic EBG absent region 10. From a different perspective, it can also be said that, as a result of the patch-shaped patterns 4*a* being arranged around the patch radiating element 5 as shown in FIG. 1, the patch-shaped patterns 4*a* form the EBG absent region 10.

In addition, as shown in FIG. 1(*b*), a line that is perpendicular to the dominant polarized wave direction (that is, parallel to the y-axis direction) and passes through substantially the center portion of the patch radiating element 5 in the dominant polarized wave direction (the center (gravitational center) of the square patch radiating element 5, according to the present embodiment) is set as a virtual patch line 100. When the distance from an arbitrary point on the patch line 100 to the region boundary of the EBG absent region 10 in the dominant polarized wave direction (the distance to the patch-shaped patterns 4*a* forming the region boundary) is an absent distance L, the EBG absent region 10 can be expressed as follows.

That is, the absent distance L to the area (referred to, hereafter, as a "right-side area") further toward one end side of the dielectric substrate 2 in the dominant polarized wave direction from the patch line 100 (the right side of the patch line 100 in FIG. 1) is set as a right-side absent distance La. The absent distance L to the area (referred to, hereafter, as a "left-side area") on the other side (the left side of the patch line 100 in FIG. 1) is set as a left-side absent distance Lb. The right-side absent distance La and the left-side absent distance Lb are both formed such as to change into a plurality of types depending on the position on the patch line 100.

Specifically, absent distances La0 and Lb0 from the center position of the patch radiating element 5 on the patch line 100 are the longest. More specifically, the longest absent distances La0 and Lb0 are each about five times the length of the wavelength λg. The longest absent distances La0 and Lb0 each being set to about five times the length of the wavelength λg is not a requisite and is merely an example. However, it is preferable that a length of about five times the wavelength λg be ensured The absent distances La and Lb each continuously decrease (more precisely, decrease in steps) toward the lower end (lower end in FIG. 1) and the upper end (upper end in FIG. 1) of the dielectric substrate 2 from the center position of the patch radiating element 5 on the patch line 100. The right-side absent distance La and the left-side absent distance Lb have the same length at the same position on the patch line 100.

In other words, the patch-shaped patterns 4*a* configuring the EBGs 4 are arranged so as to establish a linearly symmetrical positional relationship on the substrate front surface, with the patch line 100 as the axis of symmetry. That is, the EBG absent region 10 is formed into a linearly symmetrical rhomboid with the patch line 100 as the axis of symmetry.

According to the present embodiment, the patch radiating element 5 is disposed in the center of the EBG absent region 10. The conductor plate 6 is formed in substantially the overall area of the EBG absent region 10, excluding the area of the patch radiating element 5. The conductor plate 6 is not directly electrically connected to the ground plate on the substrate back surface. However, the conductor plate 6, together with the ground plate 3 on the substrate back surface, functions as the ground for the patch antenna 7. However, the conductor plate 6 is not a requisite in the antenna apparatus 1 and may be omitted.

As described above, in the antenna apparatus 1 according to the present embodiment, the EBG absent region 10 is provided in the periphery of the patch radiating element 5. In addition, the EBG absent region 10 is formed such that the absent distances La and Lb from the patch line 100 differ depending on the position on the patch line 100. Therefore, where the absent distance is long, the surface current is transmitted over a longer distance, thus allowing the beam width to be widened. Meanwhile, because areas in which the absent distance is short are also provided, radiation positions can be dispersed as a whole.

In other words, in the antenna apparatus 1 according to the present embodiment, the EBGs 4 are arranged to form the EBG absent region 10. As a result, the transmission distance of the surface current can be ensured. The desired beam width can be retained. In addition, the EBG absent region 10 is formed (the patch-shaped patterns 4*a* of the EBGs 4 are arranged) such that the absent distances La and Lb in the EBG absent region 10 differ depending on the position on the patch line 100. As a result, the radiation positions for radiation attributed to surface current can be dispersed. Disturbance in directivity (ripples and the like) can be suppressed.

[Second Embodiment]

Figure 5:
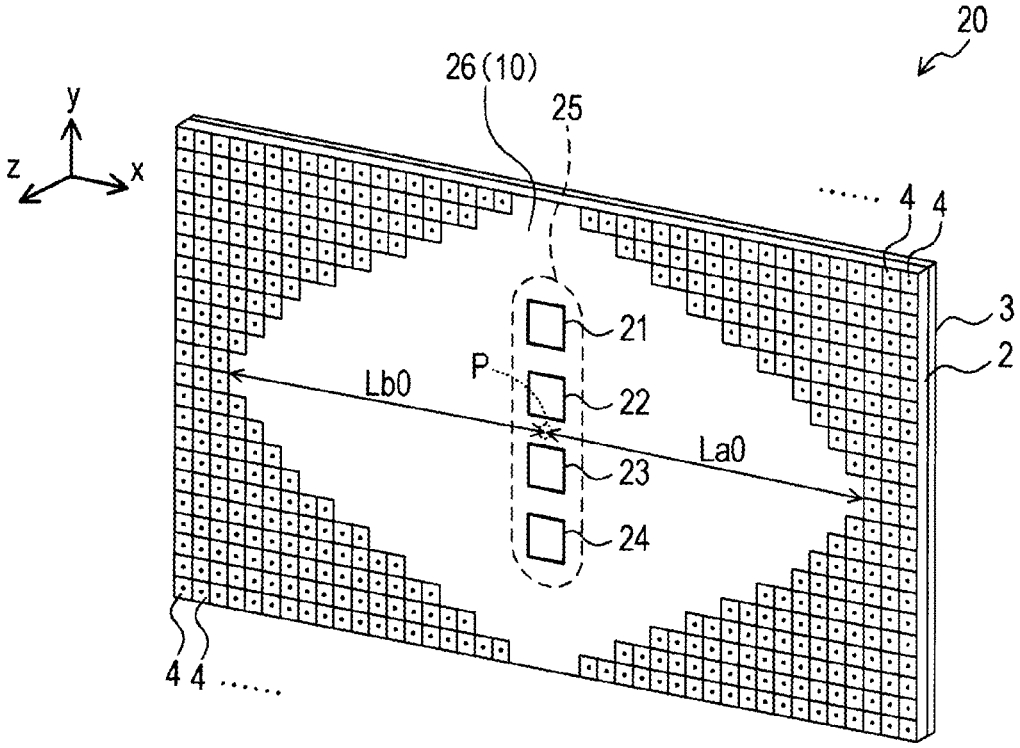
FIG. 5 is a perspective view of an overall configuration of an antenna apparatus according to a second embodiment.

An antenna apparatus 20 according to a second embodiment shown in FIG. 5 differs from the antenna apparatus 1 according to the first embodiment shown in FIG. 1 in terms of the configuration of a patch antenna 25. That is, whereas the patch antenna 7 according to the first embodiment is provided with a single patch radiating element 5, the patch antenna 25 according to the present embodiment is configured such that a plurality (four, in the present embodiment) of patch radiating elements 21, 22, 23, and 24 are arrayed at a predetermined interval in the vertical direction (y-axis direction) in the center portion of the dielectric substrate 2.

The shape and size of each patch radiating element 21 to 24 are the same as those of the patch radiating element 5 according to the first embodiment. According to the present embodiment, power supply to the patch radiating elements 21 to 24 is configured such that a microstrip line for power supply is branched and the patch radiating elements 21 to 24 are supplied power by an electromagnetic coupling-type power supply method.

Aside from the configuration of the patch antenna 25 (the number of patch radiating elements), the configuration of the antenna apparatus 20 is basically the same as that of the antenna apparatus 1 according to the first embodiment. In other words, a plurality of EBGs 4 are arranged in the periphery of the patch antenna 25 to form the rhombic EBG absent region 10. In a manner similar to that according to the first embodiment, a conductor plate 26 is formed in the area within the EBG absent region 10 excluding the area of the patch antenna 25. However, the conductor plate 26 may be omitted.

In addition, the patch antenna 25 is disposed such that a center point P thereof is positioned in the center portion of the EBG absent region 10. The center point P of the patch antenna 25 is the center point in the vertical direction (y-axis direction) of the overall vertical direction length of the four patch radiating elements 21 to 24. In the lateral direction (x-axis direction), the center point P is the center point in the lateral direction of the patch radiating elements 21 to 24, and is in the same position as the center point of the patch radiating element 5 according to the first embodiment.

Therefore, the distance (absent distance L) in the dominant polarized wave direction from a virtual patch line (not shown in FIG. 5) that passes through the center point P of the patch antenna 25 to the region end portion is set such that the absent distances La0 and Lb0 from the center point P of the patch antenna 25 are the longest and equal to each other. The absent distances La and Lb then become continuously shorter (more specifically, become shorter in steps) towards the substrate upper end and the substrate lower end.

Figure 6:
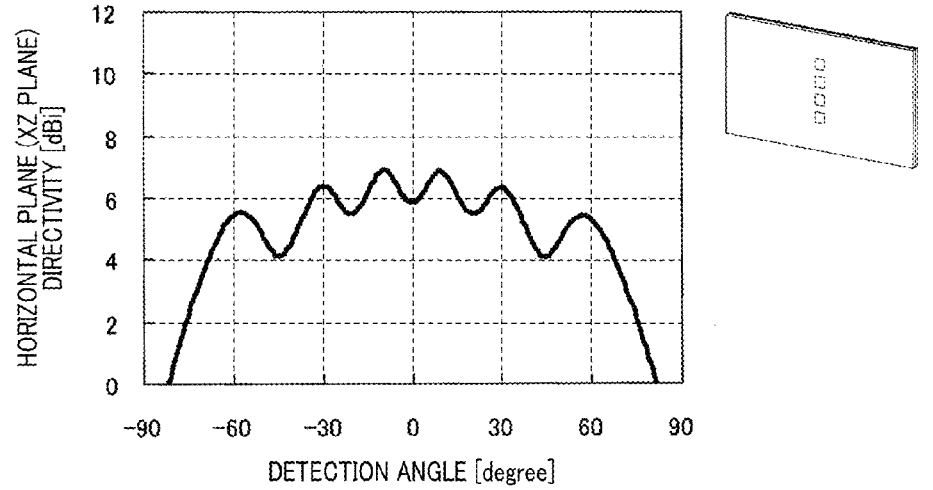
FIGS. 6(*a*) and 6(*b*) show are explanatory diagrams for explaining functional differences (in particular, the differences in horizontal plane directivity) between the antenna apparatus according to the second embodiment and a conventional antenna apparatus.
Figure 6:
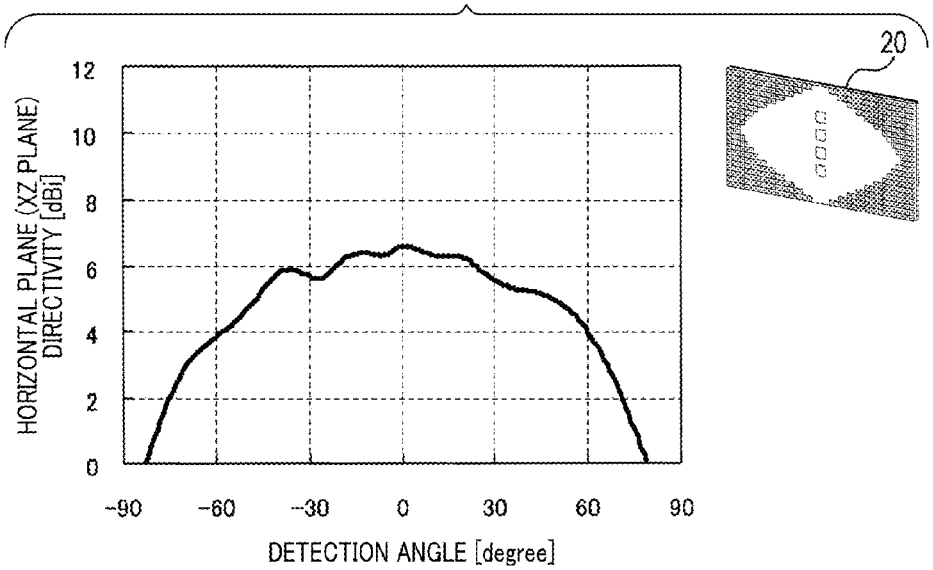

Regarding the horizontal plane (xz plane) directivity in the direction ahead of the vehicle (the side of the substrate front surface on which the patch antenna 25 is formed) of the antenna apparatus 20 according to the present embodiment, configured as described above, decrease in gain over a predetermined angular range is suppressed as shown in FIG. 6(*b*), compared to a reference configuration (a configuration in which the EBGs 4 are not provided) shown in FIG. 6(*a*).

In other words, regarding the directivity of an antenna apparatus having the reference configuration in which the EBGs 4 are not provided, ripples (decrease in gain) occur near ±45°, as shown in FIG. 6(*a*). One of the main reasons for this decrease in gain is the surface current transmitted to the substrate end portions and the unnecessary emission from the substrate end portions.

In this regard, in the antenna apparatus 20 according to the present embodiment, the plurality of EBGs 4 are arranged such as to form the rhombic EBG absent region 10. As a result, ensuring surface current (as well as ensuring beam width) and suppressing ripples through dispersion of radiation positions can be actualized. Therefore, regarding the directivity of the antenna apparatus 20 according to the present embodiment, fluctuations in gain can be significantly suppressed as shown in FIG. 6(*b*), compared to that in the reference configuration. The antenna apparatus 1 according to the first embodiment shown in FIG. 1 also has directivity with the same tendencies as that in FIG. 6(*b*).

Therefore, like the antenna apparatus 1 according to the first embodiment, the antenna apparatus 20 according to the present embodiment can achieve both suppression of disturbance in directivity (ripples and the like) and retention of the desired beam width.

[Third Embodiment]

Figure 7:
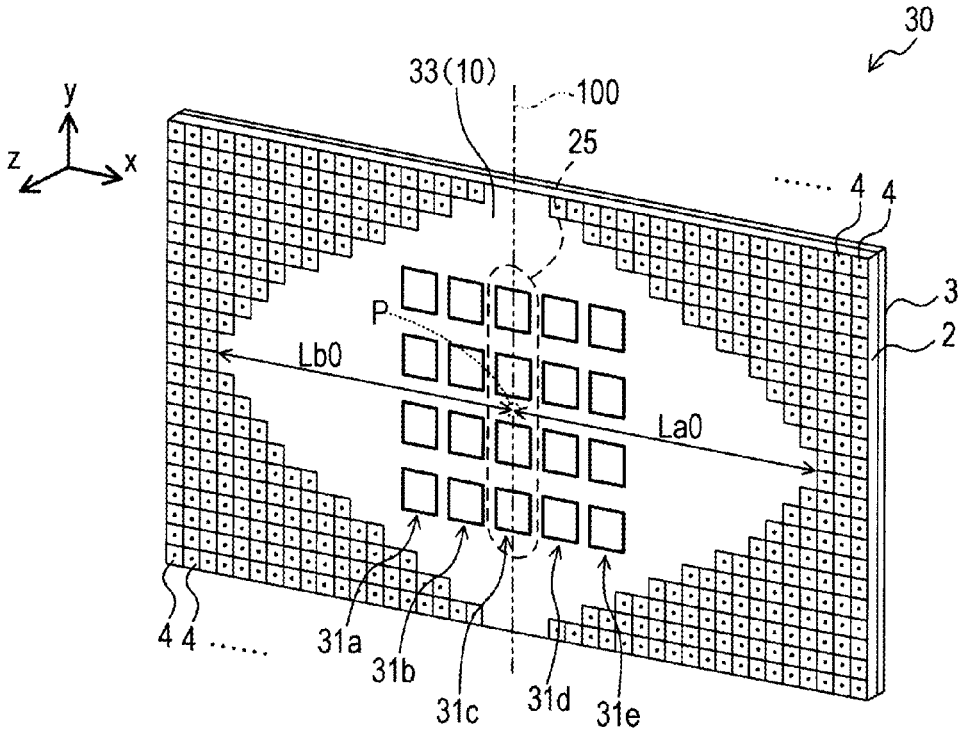
FIG. 7 is a perspective view of an overall configuration of an antenna apparatus according to a third embodiment.

An antenna apparatus 30 according to a third embodiment shown in FIG. 7 differs from the antenna apparatus 20 according to the second embodiment shown in FIG. 5 in terms of the patch radiating elements being formed on both the left and right sides of the patch antenna 25. The antenna apparatus 30 according to the third embodiment is the same as the antenna apparatus 20 according to the second embodiment in terms of other aspects.

That is, whereas the patch antenna 25 according to the second embodiment is provided with the four patch radiating elements 21 to 24 that are arrayed at a predetermined interval in the vertical direction, the antenna apparatus 30 according to the present embodiment is configured such that a plurality (five, according to the present embodiment) of radiating element groups are arrayed at a predetermined interval in the dominant polarized wave direction. Here, the patch radiating elements 21 to 24 of the patch antenna 25 according to the second embodiment is considered to be a single radiating element group.

Specifically, a radiating element group 31*c* configuring the patch antenna 25 is at the center. Two radiating element groups 31*a* and 31*b* are arranged on the left side of the radiating element group 31*c*. Two radiating element groups 31*d* and 31*e* are arranged on the right side of the radiating element group 31*c*. The radiating element groups 31*a* to 31*e* are arranged at an even interval in the dominant polarized wave direction. Power can be individually supplied to the five radiating element groups 31*a* to 31*e*. Therefore, with a single radiating element group serving as a single channel, the antenna apparatus 30 is capable of transmitting and receiving radio waves amounting to five channels.

A plurality of EBGs 4 are arranged in the periphery of the patch antenna composed of these radiating element groups 31*a* to 31*e*. The EBGs 4 form the rhombic EBG absent region 10. In a manner similar to that according to the first embodiment, a conductor plate 33 is formed in the area of the EBG absent region 10, excluding the area of the patch antenna. However, the conductor plate 33 may be omitted.

A center point P of the overall five radiating element groups 31*a* to 31*e* in the antenna apparatus 30 according to the present embodiment is in the same position as the center point of the antenna apparatus 1 according to the first embodiment and the center point P of the antenna apparatus 20 according to the second embodiment. The distance (absent distance L) in the dominant polarized wave direction from a virtual patch line (not shown in FIG. 7) that passes through the center point P of the radiating element groups 31*a* to 31*e* to the region end portion is set such that the absent distances La0 and Lb0 from the center point P are the longest and equal to each other. The absent distances La and Lb then become continuously shorter (more specifically, become shorter in steps) towards the substrate upper end and the substrate lower end.

Figure 8:
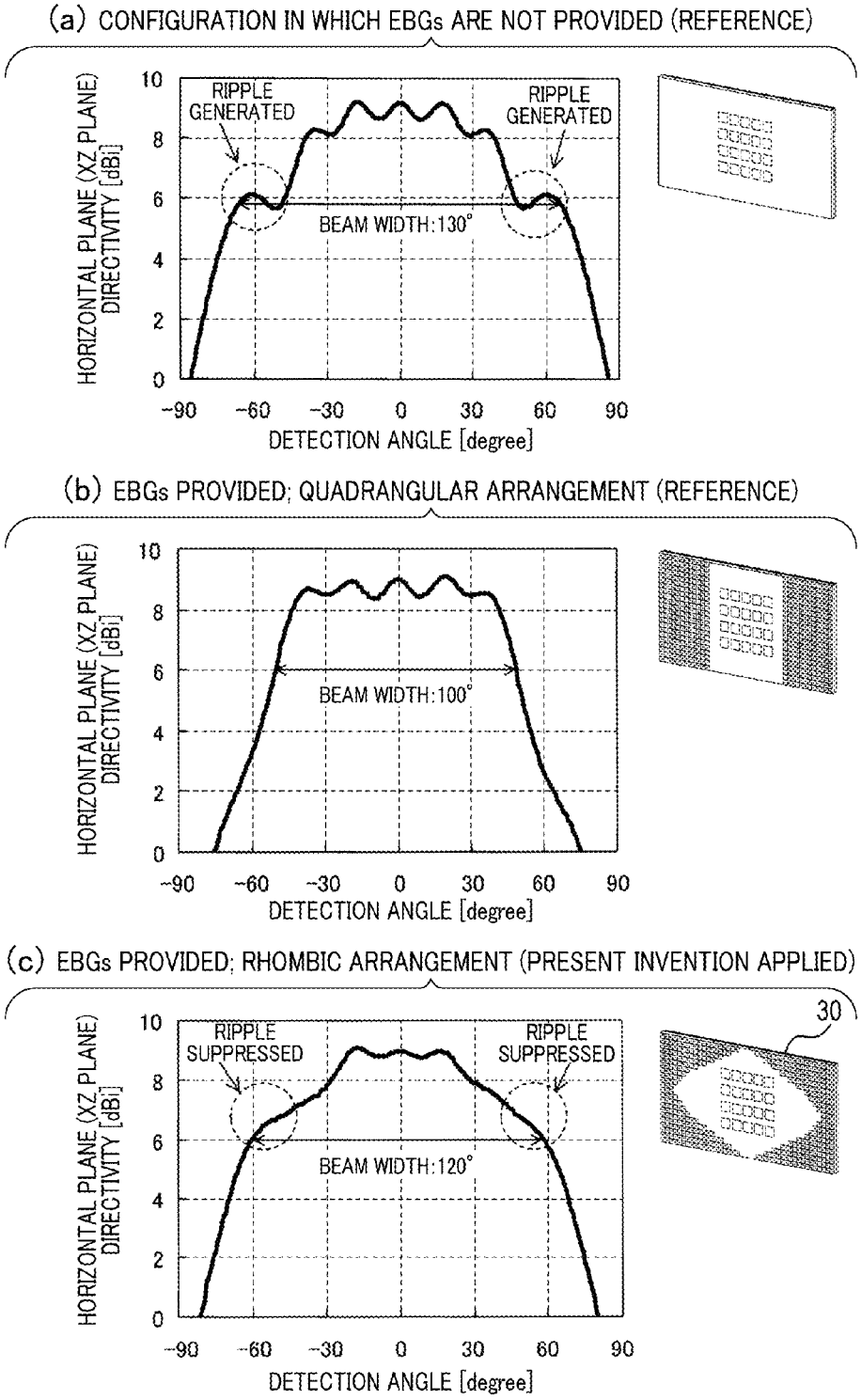
FIGS. 8(*a*) to 8(*c*) show explanatory diagrams for explaining functional differences (in particular, the differences in horizontal plane directivity) between the antenna apparatus according to the third embodiment and a conventional antenna apparatus.

Regarding the horizontal plane (xz plane) directivity in the direction ahead of the vehicle of the antenna apparatus 30 according to the present embodiment, configured as described above, decrease in gain over a predetermined angular range is suppressed as shown in FIG. 8(*c*), compared to a reference configuration (a configuration in which the EBGs 4 are not provided) shown in FIG. 8(*a*). In addition, the beam width is wider compared to that of a reference configuration (a configuration in which the width of the EBG absent region is fixed) shown in FIG. 8(*b*). The directivities shown in FIG. 8(*a*) to FIG. 8(*c*) each indicate directivity when power is supplied to only a single radiating element group in the center portion (corresponding to the patch antenna 25), among the five radiating element groups.

Figure 9:
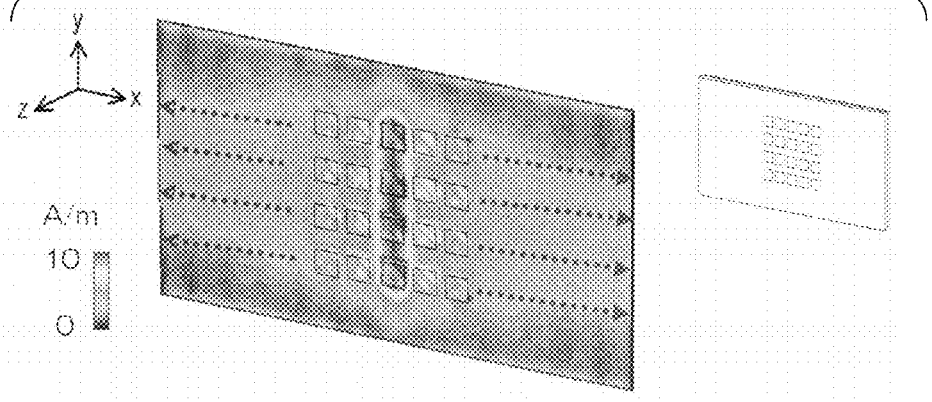
FIGS. 9(*a*) to 9(*c*) show explanatory diagrams for explaining functional differences (in particular, the differences in surface current distribution) between the antenna apparatus according to the third embodiment and a conventional antenna apparatus.
Figure 9:
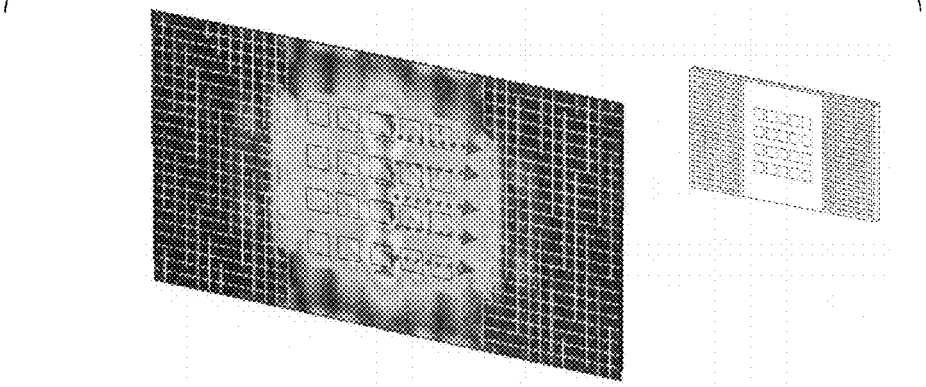
Figure 9:
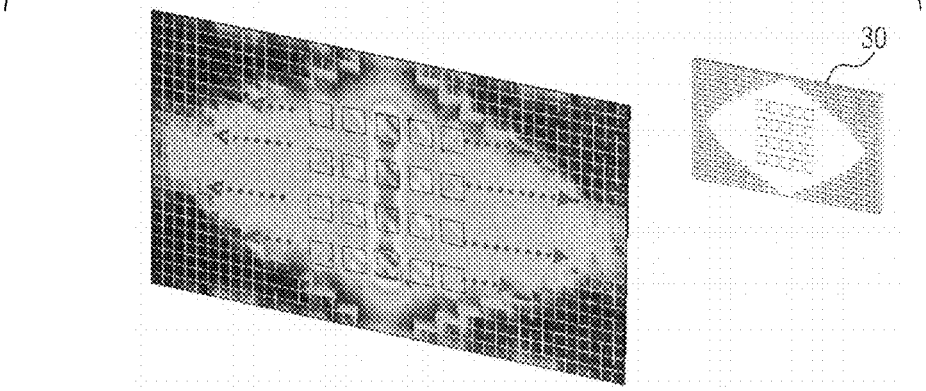

In the reference configuration in FIG. 8(*a*) in which the EBGs 4 are not provided, current distribution is as shown in FIG. 9(*a*). The surface current is transmitted to the substrate end portions, and a strong radiation is generated from the substrate end portions. Therefore, regarding directivity, a ripple is generated near ±50°, as shown in FIG. 8(*a*).

In addition, in the reference configuration in FIG. 8(*b*), current distribution is as shown in FIG. 9(*b*). The transmission distance of the surface current is equal from any position on the patch line. In addition, the transmission distance is restricted to a short distance. Therefore, as shown in FIG. 8(*b*), regarding directivity, the beam width is narrow. In the antenna apparatus 1 according to the first embodiment as well, should the EBGs be arranged as shown in FIG. 8(*b*), the current distribution becomes the similar to that shown in FIG. 9(*b*). The beam width becomes narrow in a manner similar to that shown in FIG. 8(*b*).

Meanwhile, in the antenna apparatus 30 according to the present embodiment, current distribution is as shown in FIG. 9(*c*). That is, the surface current is transmitted to the vicinity of the substrate end portions from the center point and the vicinity thereof in the vertical direction. The transmission distance of the surface current gradually shortens from the center point towards the substrate upper end and the substrate lower end. Therefore, regarding directivity, decrease in gain (ripples) is suppressed as shown in FIG. 8(*c*), compared to the reference configuration in FIG. 8(*a*) in which the EBGs 4 are not provided. In addition, the beam width is retained at substantially the same level.

Therefore, in a manner similar to the antenna apparatus 1 according to the first embodiment, the antenna apparatus 30 according to the present embodiment can also achieve both suppression of disturbance in directivity (such as ripples) and retention of the desired beam width.

[Other Embodiments]

(1) The manner in which the plurality of EBGs are arranged (the shape of the EBG absent region) in the antenna apparatus is not limited to the rhomboid according to the above-described embodiments. Various arrangement shapes are possible.

Figure 10:
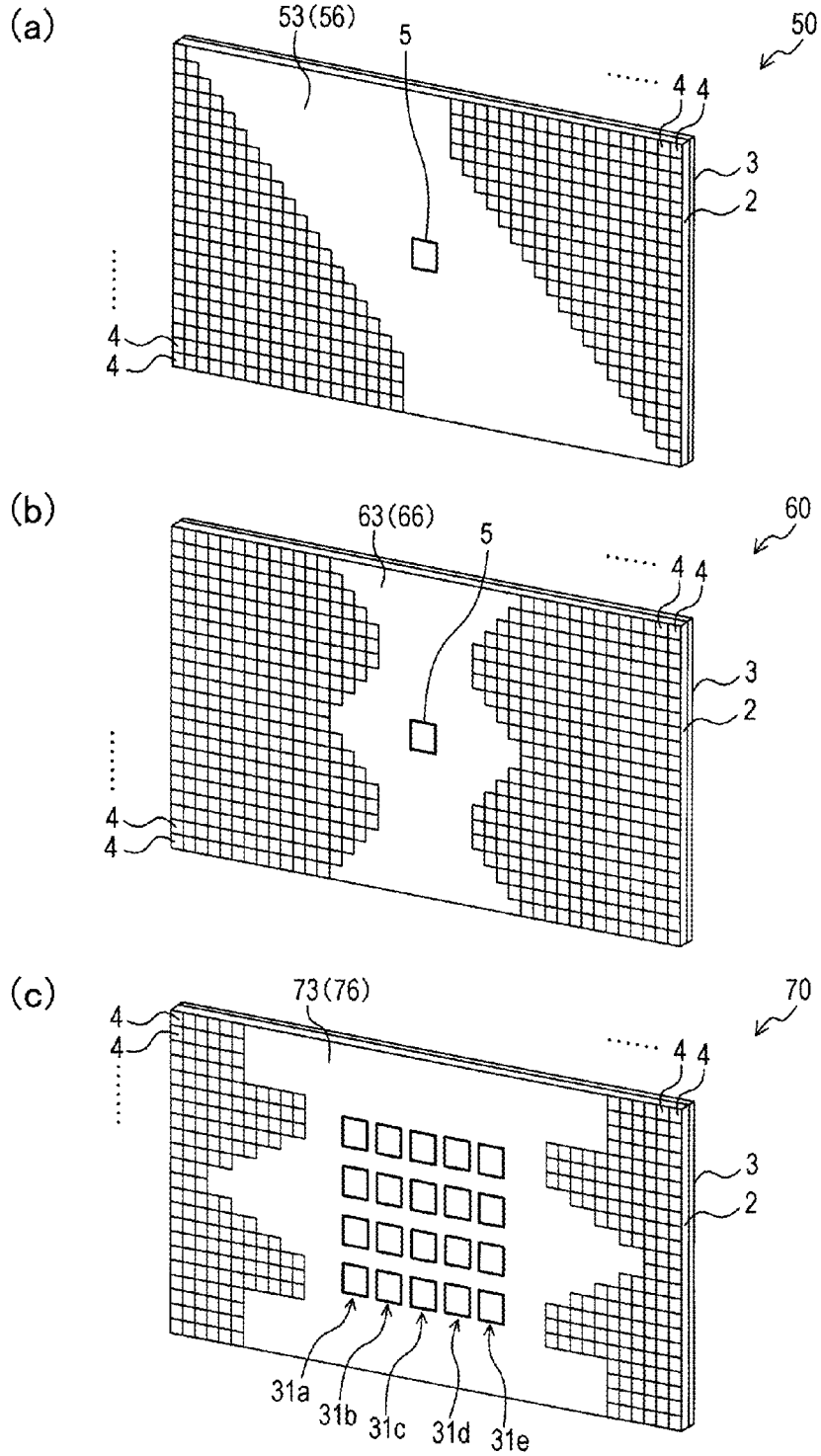
FIGS. 10(*a*) to 10(*c*) show perspective views of antenna apparatuses according to other embodiments.

For example, the EBGs 4 may be arranged to form a substantially parallelogram-shaped EBG absent region 56, as in an antenna apparatus 50 shown in FIG. 10(*a*). A conductor plate 53 may or may not be formed in the EBG absent region 56.

In addition, for example, the EBGs 4 may be arranged to form an EBG absent region 66 of which the region boundary is in a triangular-wave shape, as in an antenna apparatus 60 shown in FIG. 10(*b*). In this case as well, a conductor plate 63 may or may not be formed in the EBG absent region 66.

Furthermore, for example, an EBG absent region 76 may be formed as in an antenna apparatus 70 shown in FIG. 10(*c*). In the EBG absent region 76, the absent distance L from the center portion is the longest and becomes gradually shorter in the upward and downward directions in a manner similar to that in the antenna apparatuses according to the embodiments described above, within an area including the center portion and having a predetermined width above and below the center portion (substantially the area in which the radiating element groups 31*a* to 31*e* are present) in the vertical direction. The region width is fixed in other areas. In this case as well, a conductor plate 73 may or may not be formed in the EBG absent region 76.

The three examples shown in FIG. 10(*a*) FIG. 10(*c*) are merely examples. As long as the shape is such that the absent distance from the patch line changes into a plurality of types depending on the position on the patch line, EBG absent regions of various shapes can be formed.

However, a shape in which, within at least some predetermined areas on the patch line, the absent distance from one end of the predetermined area to the other end increases or decreases in a continuous manner or in stages is preferred. More preferably, the EBG absent region is formed such that the absent distance from the center position of the patch antenna on the patch line is the longest.

Figure 11:
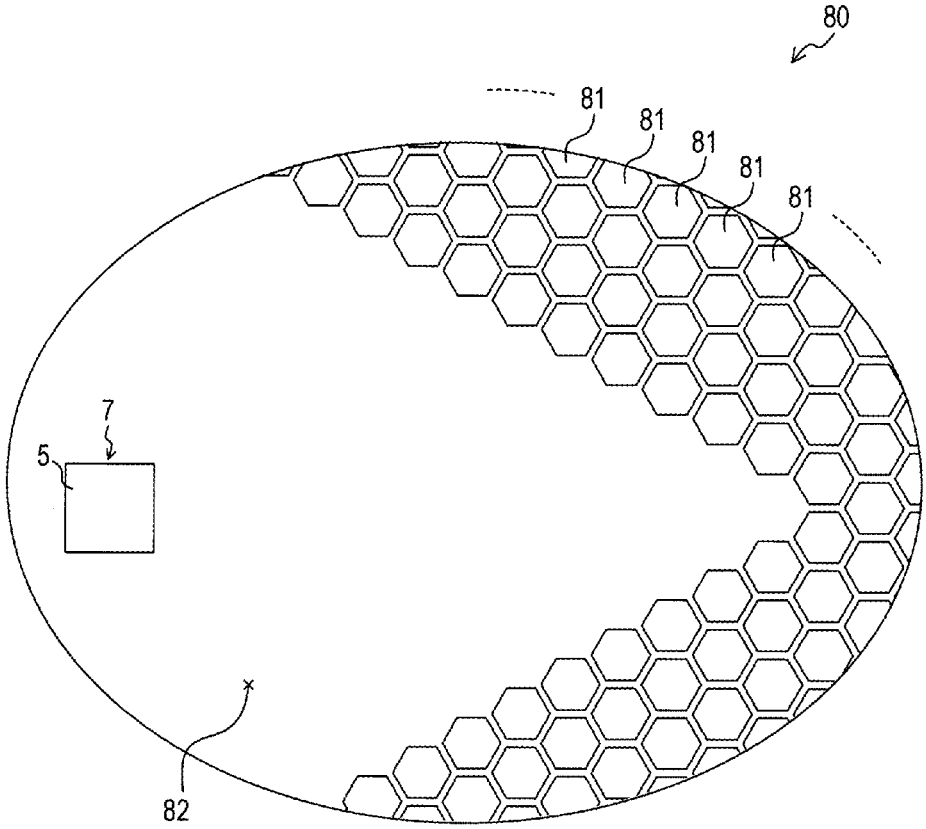
FIG. 11 is an explanatory diagram of an antenna apparatus according to another embodiment.

(2) The shape of the patch-shaped pattern 4*a* configuring the EBG 4 is not limited to a quadrangle (square). Other shapes are possible. For example, as in an antenna apparatus 80 shown in FIG. 11, a plurality of EBGs 81, each having a hexagonal patch-shaped pattern, may be arranged. FIG. 11 shows an enlargement of only a portion of the overall antenna apparatus 80 including the patch antenna 7. In the antenna apparatus 80 shown in FIG. 11 as well, the plurality of EBGs 81 having the hexagonal patch-shaped patterns are arranged such that the overall EBG absent region 82 is rhombic.

The hexagonal patch-shaped pattern is merely an example of the present invention. Various shapes can be used as the shape of the patch-shaped pattern of the EBG as long as the function as the EBG can be provided. In addition, the arrangement direction, arrangement interval, and the like of the patch-shaped patterns can be determined as appropriate. Furthermore, not all patch-shaped patterns are required to have the same shape. A configuration in which patch-shaped patterns of differing shapes are present together is also possible.

(3) The number of patch radiating elements configuring the patch antenna, as well as the shape, size, and the like thereof, can also be determined as appropriate.

REFERENCE SIGNS LIST

1, 20, 30, 50, 60, 70, 80: antenna apparatus
2: dielectric substrate
3: ground plate
4, 81: EBG
4*a*: patch-shaped pattern
4*b*: via
5, 21 to 24: patch radiating element
6, 26, 33, 53, 63, 73: conductor
7, 25: patch antenna
10, 56, 66, 76, 82: EBG absent region
31*a* to 31*e*: radiating element group
100: patch line
P: center point

The invention claimed is:

1. An antenna apparatus, comprising;

a dielectric substrate having two faces, in which a ground plate is formed on one substrate face of the two faces;

a patch antenna provided with at least a single patch radiating element for power supply, the patch radiating element being formed on the other substrate face of the dielectric substrate, the other substrate face being opposite to the one substrate face on which the ground plate is formed, a predetermined direction on the substrate face of the dielectric substrate being set as a dominant polarized wave direction;

a plurality of conductive structures provided with a patch-shaped conductor pattern formed on a substrate surface, which is the other substrate face, and a connecting conductor formed to pass through the dielectric substrate between the conductor pattern and the ground plate in order to electrically connect the conductor pattern and the ground plate, and a conductor plate, wherein the plurality of conductive structures are arranged such that a structure absent region is formed on the substrate surface by the conductive structures, the structure absent region completely including the patch radiating element of the patch antenna and excluding the conductor pattern of the conductive structure from the structure absent region;

the conductor plate formed to enclose the patch radiating element in the structure absent region on the substrate surface; and when a line perpendicular to the dominant polarized wave direction and passing through substantially a center of the patch antenna in the dominant polarized wave direction is set as a patch line, the structure absent region is formed by the plurality of conductive structures such that, in both an area further towards one end side of the dielectric substrate relative to the patch line and an area further towards the other end side of the dielectric substrate relative to the patch line, an absent distance changes into a plurality of types depending on the position on the patch line, the absent distance referring to the distance in the dominant polarized wave direction from an arbitrary position on the patch line to the conductor pattern forming the boundary of the structure absent region.

2. The antenna apparatus according to claim 1, wherein the structure absent region is formed to allow the absent distance to increase or decrease continuously or in steps from one end to the other end defining a predetermined range occupying at least part of the patch line in both the area further towards the one end side of the dielectric substrate relative to the patch line and the area further towards the other end side of the dielectric substrate relative to the patch line.

3. The antenna apparatus according to claim 2, wherein the structure absent region is formed such that the absent distance is the longest from a center positon of the patch antenna on the patch line in both the area further towards the one end side of the dielectric substrate relative to the patch line and the area further towards the other end side of the dielectric substrate relative to the patch line.

4. The antenna apparatus according to claim 3, wherein the structure absent region is formed to allow the absent distance to decrease continuously or in steps in both a range from the center positon to one end of a predetermined range including the center positon on the patch line and a range from the center position to the other end of the predetermined range, in both the area further towards the one end side of the dielectric substrate relative to the patch line and the area further towards the other end side of the dielectric substrate relative to the patch line.

5. The antenna apparatus according to claim 4, wherein the conductor pattern composing the conductive structures is formed having a quadrangle shape or a hexagon shape.

6. The antenna apparatus according to claim 5, wherein one array of radiating elements is provided in a direction perpendicular to the dominant polarized wave direction or a plurality of arrays of radiating elements are provided in the dominant polarized wave direction, each of the arrays of patch radiating elements being composed of a plurality of the patch radiating elements arranged.

7. The antenna apparatus according to claim 2, wherein one array of radiating elements is provided in a direction perpendicular to the dominant polarized wave direction or a plurality of arrays of radiating elements are provided in the dominant polarized wave direction, each of the arrays of patch radiating elements being composed of a plurality of the patch radiating elements arranged.

8. The antenna apparatus according to claim 1, wherein the structure absent region is formed such that the absent distance is the longest from a center positon of the patch antenna on the patch line in both of the area further towards the one end side of the dielectric substrate relative to the patch line and the area further towards the other end side of the dielectric substrate relative to the patch line.

9. The antenna apparatus according to claim 8, wherein the structure absent region is formed to allow the absent distance to decrease continuously or in steps in both a range from the center positon to one end of a predetermined range including the center positon on the patch line and a range from the center position to the other end of the predetermined range, in both the area further towards the one end side of the dielectric substrate relative to the patch line and the area further towards the other end side of the dielectric substrate relative to the patch line.

10. The antenna apparatus according to claim 8, wherein the conductor pattern composing the conductive structures is formed having a quadrangle shape or a hexagon shape.

11. The antenna apparatus according to claim 8, wherein one array of radiating elements is provided in a direction perpendicular to the dominant polarized wave direction or a plurality of arrays of radiating elements are provided in the dominant polarized wave direction, each of the arrays of patch radiating elements being composed of a plurality of the patch radiating elements arranged.

12. The antenna apparatus according to claim 1, wherein the conductor pattern composing the conductive structures is formed having a quadrangle shape or a hexagon shape.

13. The antenna apparatus according to claim 1, wherein one array of radiating elements is provided in a direction perpendicular to the dominant polarized wave direction or a plurality of arrays of radiating elements are provided in the dominant polarized wave direction, each of the arrays of patch radiating elements being composed of a plurality of the patch radiating elements arranged.

14. An antenna apparatus, comprising;

a dielectric substrate having two faces, in which a ground plate is formed on one substrate face of the two faces;

a patch antenna provided with at least a single patch radiating element for power supply, the patch radiating element being formed on the other substrate face of the dielectric substrate, the other substrate face being opposite to the one substrate face on which the ground plate is formed, a predetermined direction on the substrate face of the dielectric substrate being set as a dominant polarized wave direction; and a plurality of conductive structures provided with a patch-shaped conductor pattern formed on a substrate surface, which is the other substrate face, and a connecting conductor formed to pass through the dielectric substrate between the conductor pattern and the ground plate in order to electrically connect the conductor pattern and the ground plate, wherein the plurality of conductive structures are arranged such that a structure absent region is formed on the substrate surface by the conductive structures, the structure absent region completely including the patch radiating element of the patch antenna and excluding the conductor pattern of the conductive structure from the structure absent region;

when a line perpendicular to the dominant polarized wave direction and passing through substantially a center of the patch antenna in the dominant polarized wave direction is set as a patch line, the structure absent region is formed by the plurality of conductive structures such that, in both an area further towards one end side of the dielectric substrate relative to the patch line and an area further towards the other end side of the dielectric substrate relative to the patch line, an absent distance changes into a plurality of types depending on the position on the patch line, the absent distance referring to the distance in the dominant polarized wave direction from an arbitrary position on the patch line to the conductor pattern forming the boundary of the structure absent region, and the structure absent region is formed such that the absent distance is the longest from a center positon of the patch antenna on the patch line in both the area further towards the one end side of the dielectric substrate relative to the patch line and the area further towards the other end side of the dielectric substrate relative to the patch line.

15. The antenna apparatus according to claim 14, comprising a conductor plate formed to enclose the patch radiating element in the structure absent region on the substrate surface.

16. The antenna apparatus according to claim 15, wherein the structure absent region is formed to allow the absent distance to decrease continuously or in steps in both a range from the center positon to one end of a predetermined range including the center positon on the patch line and a range from the center position to the other end of the predetermined range, in both the area further towards the one end side of the dielectric substrate relative to the patch line and the area further towards the other end side of the dielectric substrate relative to the patch line.

17. The antenna apparatus according to claim 16, wherein the conductor pattern composing the conductive structures is formed having a quadrangle shape or a hexagon shape.

18. The antenna apparatus according to claim 17, wherein one array of radiating elements is provided in a direction perpendicular to the dominant polarized wave direction or a plurality of arrays of radiating elements are provided in the dominant polarized wave direction, each of the arrays of patch radiating elements being composed of a plurality of the patch radiating elements arranged.

* * * * *